United States Patent [19]

Tela, Sr.

[11] 4,077,631

[45] Mar. 7, 1978

[54] MODERN ROULETTE GAME

[76] Inventor: Charles T. Tela, Sr., 5348 Thornburn St., Los Angeles, Calif. 90045

[21] Appl. No.: 694,461

[22] Filed: Jun. 9, 1976

[51] Int. Cl.[2] ..... A63F 5/00

[52] U.S. Cl. ..... 273/142 E

[58] Field of Search ..... 273/142 R, 142 A, 142 B, 273/142 C, 142 D, 142 E, 142 F, 142 G, 142 H, 142 HA, 142 J, 142 JA, 142 JB, 142 JC, 142 JD, 142 K, 130 H, 134 AG

[56] References Cited

U.S. PATENT DOCUMENTS

| | | | |
|---|---|---|---|
| D. 89,120 | 1/1933 | Bustanoby | 273/142 E X |
| 1,300,315 | 4/1919 | Wilder | 273/134 AG |
| 1,578,412 | 3/1926 | Ewig | 273/142 E |
| 1,670,692 | 5/1928 | Rosar | 273/142 F |
| 1,838,398 | 12/1931 | Heidbrink | 273/134 AG |
| 3,090,623 | 5/1963 | Dugan | 273/142 R |

FOREIGN PATENT DOCUMENTS

| | | | |
|---|---|---|---|
| 474,286 | 11/1914 | France | 273/142 R |
| 636,452 | 1/1928 | France | 273/142 E |
| 799,645 | 4/1936 | France | 273/142 E |
| 844,420 | 4/1939 | France | 273/142 R |
| 372,312 | 4/1923 | Germany | 273/142 R |
| 2,402,985 | 7/1975 | Germany | 273/142 E |
| 978,701 | 12/1964 | United Kingdom | 273/142 G |
| 1,012,409 | 12/1965 | United Kingdom | 273/142 R |

*Primary Examiner*—Harland S. Skogquist
*Assistant Examiner*—Arnold W. Kramer
*Attorney, Agent, or Firm*—Clarence A. O'Brien; Harvey B. Jacobson

[57] ABSTRACT

A modern roulette game having a unique and novel modern layout of groups of numerals on the chart along side of the roulette wheel and base combined with the addition of small numerals concentrically inwardly of the conventional numerals on the roulette wheel with the small numerals being oriented in relation to the original parent numerals in a manner to enable modern roulette to be played. In the modern roulette layout, the thirty-six numbers are not arranged in consecutive fashion as in the conventional roulette layout but rather are arranged in groups of four numbers per group with their being nine groups with each of the nine groups containing two numbers that are even and two numbers that are odd, and four of the groups contain all red numbers and four groups contain all black numbers with the number one group including half red numbers and half black numbers. Small numerals on the roulette wheel inwardly of the parent numerals indicate the group in which the parent numeral falls in the layout. The base for the roulette game is provided with unique leveling legs and a level indicating structure is provided on the base for assuring proper rotation of the roulette wheel.

3 Claims, 4 Drawing Figures

Fig. 1
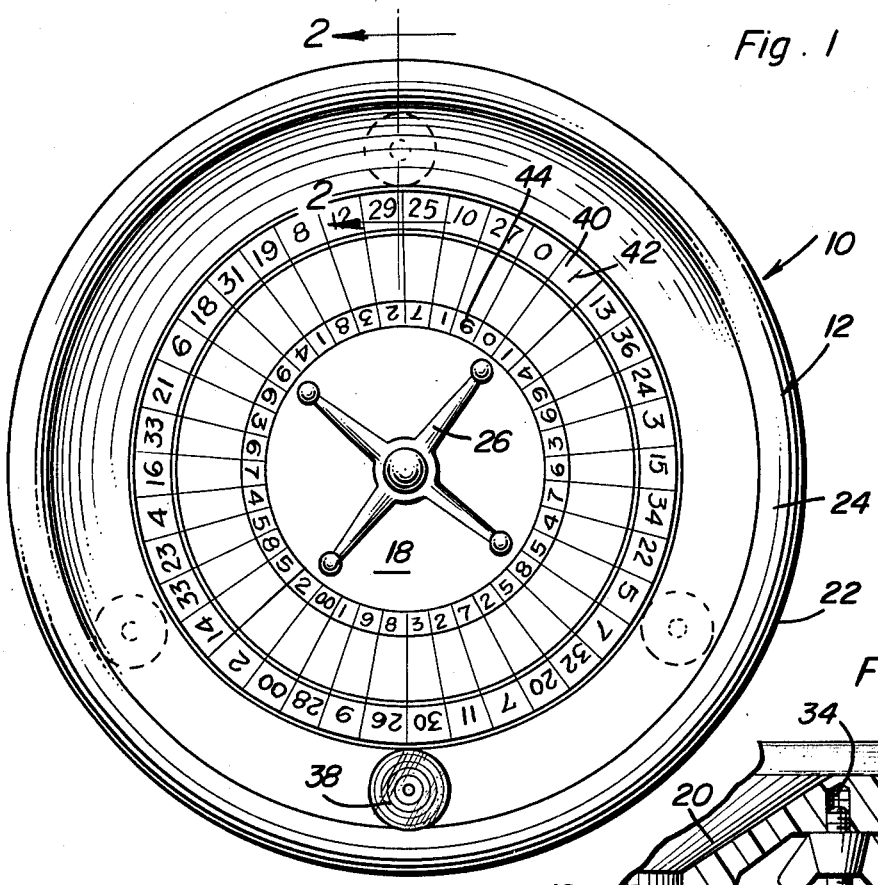
Fig. 2
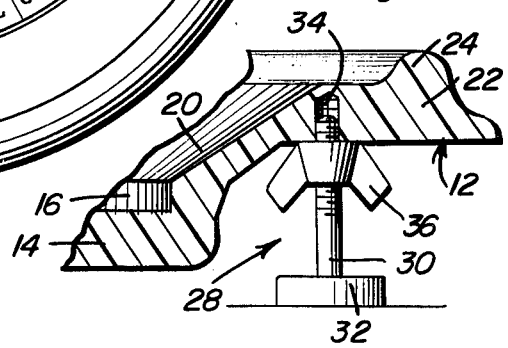
Fig. 3
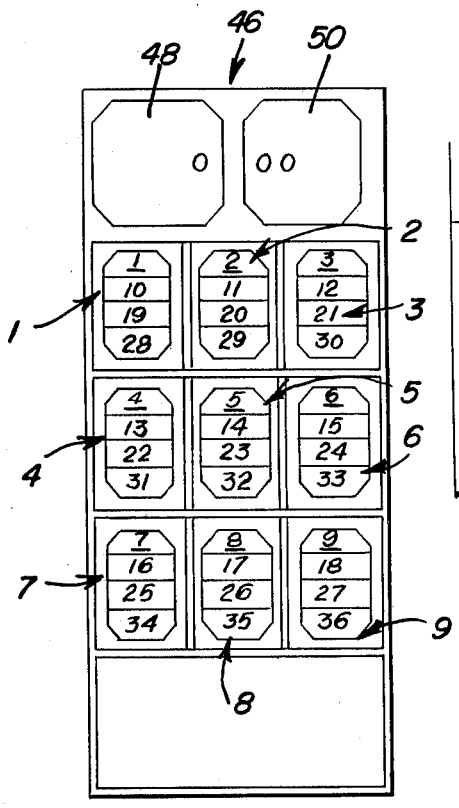
| NO. OF PLAY | GROUP NO. | WINNING NUMBERS (ODD) | WINNING NUMBERS (EVEN) | COLOR OF NUMBERS (RED) | COLOR OF NUMBERS (BLACK) |
|---|---|---|---|---|---|
| 1 | 7 | | 34 | • | |
| 2 | 8 | | 26 | | • |
Fig. 4

MODERN ROULETTE GAME

BACKGROUND OF THE INVENTION

1. Field of the Invention

The present invention generally relates to games and game devices and more particularly a roulette game in which the number layout is altered from the original layout and additional small numerals are provided on the roulette wheel adjacent the hub to indicate a group in the layout in which the parent numeral adjacent the outer periphery of the roulette wheel falls to facilitate playing of modern roulette.

2. Description of the Prior Art

Conventional roulette wheels and layouts have been in existence for many years and have been played in the same manner. The structure involved includes a dish-shaped base or case having a wheel journaled therein for rotation in one direction with the wheel being provided with a plurality of pockets on the periphery thereof. The wheel includes thirty-eight pockets with numerals 1–36, 0 and 00 associated therewith with half of the pockets being red and the other half black. The base is provided with a peripheral surface that is slanted downwardly and inwardly toward the periphery of the wheel with the wheel having a handle structure at its hub by which it may be rotated in one direction while the ball is manually projected around the inclined surface in the opposite direction so that the ball will come to rest in one of the pockets in a well known manner. The conventional layout consists of thirty-six numbers plus the 0 and 00 arranged in three rows of twelve numbers each with the numbers starting with one and running consecutively to thirty-six with half of these numbers being red and the other half being black. The conventional layout also includes various additional areas having indicia associated therewith by which a game may be played by the players positioning their bets in a particular position on the layout. Prior U.S. Pat. No. 3,090,623 discloses a roulette wheel having a structural modification and the following U.S. patents disclose other game devices including rotatable wheels associated with stationary bases.

Nos. 1,468,984; 1,606,157; 1,670,692

SUMMARY OF THE INVENTION

An object of the present invention is to provide a modern routlette game with a modern layout and the addition of small numerals radially inwardly of and aligned with the numerals associated with the peripheral pockets in a roulette wheel in which the numeral arrangement in the modern layout provides greater interest and requires greater skill as compared with conventional roulette.

Another object of the invention is to provide a modern roulette game in which the leveling features are incorporated into the case or base for the roulette wheel to assure proper balance and rotation of the roulette wheel.

A further object of the invention is to provide a modern roulette game in accordance with the preceding objects in which the modern layout includes nine groups of four numbers each with the small numerals being disposed adjacent the hub of the roulette wheel indicating which of the nine groups the parent number at the outer periphery of the wheels falls in with the small numerals also including a 0 and 00 aligned with the corresponding 0 and 00 at the outer periphery of the wheel.

These, together with other objects and advantages which will become subsequently apparent, reside in the details of construction and operation as more fully hereinafter described and claimed, reference being had to the accompanying drawings forming a part hereof, werein like numerals refer to like parts throughout.

BRIEF DESCRIPTION OF THE DRAWINGS

FIG. 1 is a top plan view of the case or base and a roulette wheel incorporated therein with the additional numbers oriented inwardly of the conventional numbers at the periphery of the wheel.

FIG. 2 is a fragmental sectional view taken generally along section line 2—2 on FIG. 1 illustrating the structure of one of the leveling legs.

FIG. 3 is a plan view illustrating the modern layout.

FIG. 4 is a plan view of a partial score sheet.

DESCRIPTION OF THE PREFERRED EMBODIMENT

The roulette device illustrated in FIGS. 1 and 2 is generally designated by numeral 10 and includes a dish-shaped case or base 12 including a bottom member 14 having a recess 16 therein receiving the rotating roulette wheel 18. A peripheral upwardly slanting surface 20 is disposed outwardly of the wheel 18 and this surface is provided on a generally horizontal flange 22 having a raised peripheral portion 24 in the form of a rib or the like, all of which represent conventional construction of a roulette device in which the roulette wheel 18 is provided with a centrally disposed handle in the form of projecting arms 26 by which the rotatable wheel may be given a spin in a desired direction. The center of the bottom member 14 is usually provided with an upstanding peg having anti-friction bearing means at the upper end thereof received in a corresponding socket in the central hub of the roulette wheel 18. The specific structure of the roulette device remains conventional except for the provision of three or more adjustable leveling legs 28, each of which is in the form of an upstanding threaded member 30 having a support surface engaging foot or pad 32 at the lower end thereof with the upper end being threaded into an internally threaded socket 34 in the lower surface of the flange 22. A wing-type lock nut 36 is threaded onto the upstanding threaded leg 30 for securing the leg 30 in adjusted position in relation to the flange 22 to enable the case or base 12 to be supported in a level condition.

A level indicator 38 is mounted on the flange 22 and the level indicator may be in the form of a single vial of a configuration having a spherical upper portion so that the bubble interiorly thereof may be used to indicate the level condition of the case or base. In lieu of the single spherical type level indicator, a pair of conventional level vials may be supported in perpendicular relation to each other on the flange 22 thus enabling the roulette device 10 to be precisely oriented in horizontal position so that free rotation of the wheel 18 and rolling movement of the ball on the inclined surface 20 will be completely free of any adverse effect that may be caused by an unlevel condition of the case or base 12.

As in conventional, the periphery of the wheel 18 which is disposed closely adjacent the inclined surface 20 is provided with a plurality of pockets 40 each of which is provided with a numeral 42 with the pockets being sufficient in size to receive the ball which is moved peripherally in the track or supporting surface 20 until gravity causes it to roll into one of the pockets 40 which is moving in the opposite direction due to rotation of the wheel 18 in a conventional manner by spinning the handle or arms 26. All of the aforedescribed structure and operation except for the leveling legs and the level indicator represent conventional construction of roulette game devices. In addition to the incorporation of the adjustable legs 28 and the level indicator 38, the roulette game device is modified from a conventional arrangement by providing additional small numerals 44 inwardly of the larger numerals 42 at the outer periphery of the wheel 18. The smaller numerals 44 are in alignment with the larger or parent numerals 42 and are disposed radially inwardly thereof and are used to facilitate playing modern roulette in a manner described hereinafter.

A conventional roulette wheel includes thirty-eight pockets and these pockets are provided with numbers 0, 00 and 1–36, inclusive, with half of the pockets identified by numerals 1–36 being red and the other half being black and the pockets identified by numerals 0 and 00 being distinguishably colored from both the red and black pockets. The numerals identifying the pockets are arranged in a particular pattern as is conventional and as illustrated in FIG. 1 which is retained in the modern roulette game thus enabling the small numerals 44 to be applied directly to a conventional roulette wheel without any modification whatsoever of the roulette wheel other than by applying the numerals which are colored in a manner corresponding to the larger or parent numeral 42 with which it is aligned. In a conventional layout or chart on a table or other suitable surface adjacent to the roulette case and wheel, the thirty-six numbers 1–36 are arranged in three rows of twelve numbers each with the numbers in the upper left corner beginning with numeral 1 and running transversely consecutively to number 36 with half of the numbers being red and the other half being black. Above the rows of numerals is a space indicating the 0 and a space indicating 00 and along side of the rows of numerals are various spaces relating to certain groups of numbers all of which can be bet by placing chips or the like on the specific spaces involved. The red numerals are 1, 3, 5, 7, 9, 12, 14, 16, 18, 19, 21, 23, 25, 27, 30, 32, 34 and 36 with the other numerals being black.

In the modern layout, illustrated in FIG. 3 and generally designated by numeral 46, spaces 48 and 50 are provided for 0 and 00 but the other numbers, 1–36, are arranged in groups of four numbers each with their being nine groups designated generally by reference numerals 1–9 respectively. The color of the respective numerals has not been altered but the numerals have been rearranged so that they are not consecutive although the numerals in each group are in ascending order, for example, in group number one numerals 1, 10, 19 and 28 are arranged in a vertical row as illustrated in FIG. 3 with numerals 1 and 19 being red and 10 and 28 being black. In groups two, four, six and eight, all of the numerals are black and in groups three, five, seven and nine, all of the numerals are red thus providing four groups in which all of the numbers are black and four groups in which all of the numbers are red and one group in which half of the numbers are red and half are black. The small numerals 44 include 0 and 00 and four sets of numerals 1–9, inclusive, which indicate the group in which the larger or parent numeral belongs on the layout 46, for example, if the ball rolled into pocket 40 having indicating numeral "1" thereon, which is red, the smaller numeral aligned therewith would also be the indicating numeral "1" indicating that the winning number belongs in group one as illustrated in FIG. 3 in the layout.

In the modern layout, the numbers which appear in the first row, that is groups one, four and seven as illustrated in FIG. 3 are exactly the same numbers as appear in the first vertical row of a conventional layout but these numbers are arranged in a different sequence and into groups of four members each and it is pointed out that each groups includes two even numbers and two odd numbers. This group arrangement when put into actual play by a player familiar with the rules of modern roulette will provide a new and interesting game and the player will play with greater assurance and confidence and will obtain a fair chance in roulette playing as compared with conventional roulette which fails to provide the player with a fair chance of winning.

The numbers on the layout are in the nine groups as indicated in FIG. 3 with each group being scientifically arranged in a mathematically significant manner. Initially, it is pointed out that the lead number of each group of the nine groups indicates what particular group that is. For example, where the lead number in the group is "5", this indicates that this group is group number five. Thus, the upper number in each vertical arranged group of four numbers indicates the group number. Thus, all of the numbers 1–9 are lead numbers for their respective groups. The creation of each of the nine groups is accomplished by the addition of nine to the lead number, after which, nine more is added to the second group number, after which, nine more is added to the third group number and thusly, the four numbers of each group is created. For example, in group 1 in FIG. 3, the lead number is "1" and by adding nine to the lead number, the second number in the group "10" is obtained and this repeats itself throughout all of the groups.

This mathematical formula is scientifically sound and represents the foundation of modern roulette. This arrangement provides a player with a fair chance of winning but also provides a much better understanding of conventional roulette.

As set forth previously, the small numerals 44 are group number indicator numerals and each of these group number indicator numerals is lined up directly with the conventional roulette number it is group related to. For example, if number 32 of the roulette came up a winner, the small group number indicator numeral directly in line with it is the group number, in this instance, group five. In this manner, the "groupier" immediately knows, when a number comes up a winner, exactly in what group that winning number belongs. Should 18 be the winning number, then it belongs in group nine, etc. Another method to quickly determine what group a winning number belongs is to add any winning double number and the sum indicates to what group the winning number belongs. For example, if number 25 wins, by adding the 2 and the 5, the answer 7 indicates that number 25 belongs to group seven. Of course, the single numbers are lead numbers and immediately identify the group to which they belong.

In playing conventional roulette, a player can select and play any single number or group of numbers, either the red or black colors, at odds or even money, even numbers, odd numbers, rows or sections of twelve numbers. Comparatively, modern roulette is primarily played by groups with each full group consisting of four numbers. As a player advances in modern roulette, he can then play by half groups which means that he selects two numbers from each chosen group, at odds of 17 to 1 and as he becomes more proficient, he can play one number from a chosen group at the full odds of 35 to 1. In playing modern roulette, a scoresheet should be used which is provided with five columns with the first column being for recording the number of plays, the second column for recording the group number that the winning number belongs to which should be put down in its color, either red or black. The next two columns are for recording the odd or even winning numbers With the third column being for odd numbers and the fourth column for even with the winning numbers also being put down in their color. The last two columns are for recording the red and black wins. Two typical plays are illustrated in FIG. 4 in which the first recorded play indicates that number 34 was the winning number and that it belongs to group seven with the numerals "7" and "34" being written in red and an appropriate red dot is placed in the appropriate column. The second winning number illustrated in FIG. 4 is 26 which falls in group eight and is correspondingly written in black ink and an appropriate dot provided in the last column.

In playing modern roulette, when twelve plays have been recorded, the groups which have won twice or more within these twelve plays is recorded. These groups, designated "hot" groups, should be played to the exclusion of the other groups and the player may proceed to play these groups, one chip per group. If a player wishes, he may increase his bets one chip or more, after each play but he should not go beyond six to eight chips with the player making his own limit. By determining the groups in which the winning numbers fall at periodic intervals during play of a game, the list of "hot" groups may be altered. With this arrangement, full groups are played in modern roulette and by recording the results of play, the player has a much better chance of winning by employing his skill as compared with conventional roulette.

In playing half groups, a player can either play the even two numbers or the odd two numbers of any selected group. For example, if in the aforementioned plays, certain groups are "hot", these groups may be played on the odd part. For example, if group one is a "hot" group, numbers 1 and 19 would be bet and the odds are 17 to 1 and the betting limit may be extended up to twelve plays by increasing the chip betting on loosing groups one chip after each unsuccessful play. Of course, the player has a choice of playing either odds or evens in half group plays. If desired, single numbers from each group may be played in which event the odds are 35 to 1 and the limits of the bets may vary as desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A modern roulette game comprising the combination of a stationary base of dish-shape rotatably supporting a roulette wheel therein, said roulette wheel including a plurality of peripheral pockets on the upper surface thereof, a numeral associated with each pocket, said base including a peripheral inclined surface concentric with the wheel for receiving a ball rollably thereon in which the ball will roll into one of the pockets when the ball slows, and a layout of the numerals identifying the pockets on an adjacent planar surface, said layout including a plurality of groups of numerals with each group having a predetermined equal number of numerals on which chips may be positioned when betting which numbered pocket the ball will enter, a smaller set of numerals positioned on the wheel inwardly of the peripheral numerals with each numeral of the smaller set in radial alignment with a respective peripheral numeral with the smaller group of numerals indicating the group of numerals on the layout to which its aligned numeral on the outer periphery of the wheel belongs, the numerals on the outer periphery of the wheel including 0, 00 and 1–36, inclusive, said groups of numerals on the layout including numerals 1–36 divided into nine groups of four numerals each with numerals 1–9 indicating the nine groups and being the uppermost lead numeral in each group, the smaller set of numerals on the roulette wheel inwardly of the periphery thereof including four sets of numerals 1–9, and one each of 0 and 00, said numerals being associated with distinguishable colors with the numerals 1–36 including one-half of the numerals being red and the other one-half being black, the first group of numerals on the layout including two red numerals and two black numerals, four of the groups including all black numerals and four of the groups including all red numerals, the addition of the two digits of double digit numbers indicating the group to which the double digit number belongs, each subsequent numeral in each group being nine more than the preceding numeral in each group.

2. In a roulette game apparatus including a stationary base of dish-shape, a roulette wheel rotatably supported in said base, said roulette wheel including a plurality of peripheral pockets on the upper surface thereof, peripheral identifying numerals associated with said pockets, said base including a peripheral inclined surface concentric with the wheel for receiving a ball rollably thereon with the ball rolling into one of the pockets when it slows, and a layout of the numerals identifying the pockets on an adjacent planar surface, that improvement comprising an inner set of numerals positioned on the wheel radially inwardly of the peripheral numerals with each numeral of the inner set in radial alignment with a respective peripheral numeral, said numerals on the layout including a plurality of groups of numerals with each group having a predetermined equal number of numerals on which chips may be positioned when betting which numbered pocket the ball will enter, the peripheral numerals on the wheel including 0, 00 and 1–36, inclusive, said groups of numerals on the layout including numerals 1–36 divided into nine groups of four numerals each with numerals 1–9 indicating the nine groups and being the uppermost lead numeral in each group, the set of inner numerals on the roulette wheel including four sets of numerals 1–9, and one each of 0 and 00, and indicating the group of numerals on the layout to which its aligned peripheral numeral belongs, the first group of numerals on the layout including two red numerals and two black numerals, four of the groups on the layout including all red numerals, and four of the groups on the layout including all black numerals.

3. The structure as defined in claim 2, wherein each subsequent numeral in each group is nine more than the preceding numeral, the addition of the two digits of double digit numerals indicating the group to which the double digit numeral belongs.

* * * * *